US010946242B2

(12) United States Patent
Shibuya

(10) Patent No.: US 10,946,242 B2
(45) Date of Patent: Mar. 16, 2021

(54) SWING ANALYSIS DEVICE, SWING ANALYSIS METHOD, AND SWING ANALYSIS SYSTEM

(71) Applicant: SEIKO EPSON CORPORATION, Tokyo (JP)

(72) Inventor: Kazuhiro Shibuya, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 18 days.

(21) Appl. No.: 16/448,131

(22) Filed: Jun. 21, 2019

(65) Prior Publication Data

US 2019/0388730 A1 Dec. 26, 2019

(30) Foreign Application Priority Data

Jun. 22, 2018 (JP) ..... JP2018-118643

(51) Int. Cl.

| | |
|---|---|
| ***A63B 24/00*** | (2006.01) |
| ***A63B 69/36*** | (2006.01) |
| ***A63B 60/46*** | (2015.01) |
| *A63B 71/06* | (2006.01) |

(52) U.S. Cl.

CPC ..... *A63B 24/0006* (2013.01); *A63B 60/46* (2015.10); *A63B 69/36* (2013.01); *A63B 69/3621* (2020.08); *A63B 69/3629* (2020.08); *A63B 2024/0012* (2013.01); *A63B 2071/0694* (2013.01)

(58) Field of Classification Search

None

See application file for complete search history.

(56) References Cited

U.S. PATENT DOCUMENTS

| | | | | |
|---|---|---|---|---|
| 9,744,421 | B2 | 8/2017 | Chan | |
| 2004/0172213 | A1* | 9/2004 | Kainulainen | A63B 69/3608 702/141 |
| 2006/0247070 | A1* | 11/2006 | Funk | A63B 24/0006 473/222 |
| 2009/0247312 | A1* | 10/2009 | Sato | A63B 69/3632 473/223 |
| 2011/0143866 | A1* | 6/2011 | McConnell | A63B 69/3623 473/409 |
| 2013/0143682 | A1 | 6/2013 | Ueda et al. | |
| 2013/0178304 | A1* | 7/2013 | Chan | G06T 7/254 473/266 |
| 2013/0267339 | A1* | 10/2013 | Boyd | A63B 60/00 473/223 |
| 2014/0213382 | A1* | 7/2014 | Kang | A63B 69/3632 473/223 |

(Continued)

FOREIGN PATENT DOCUMENTS

| | | | |
|---|---|---|---|
| JP | 2013-118876 | A | 6/2013 |
| JP | 2013-202066 | A | 10/2013 |

(Continued)

*Primary Examiner* — Jason T Yen

(74) *Attorney, Agent, or Firm* — Oliff PLC

(57) ABSTRACT

A swing analysis device includes: an acquisition unit (swing video acquisition unit) acquiring a swing video of a user; a processing unit deciding an impact timing and a tempo, based on the swing video; and a display unit displaying the swing video and the tempo. The display unit, while displaying the swing video, displays the tempo when the impact timing is reached in the swing video.

11 Claims, 16 Drawing Sheets

(56) References Cited

U.S. PATENT DOCUMENTS

| | | | | | |
|---|---|---|---|---|---|
| 2015/0328523 | A1* | 11/2015 | Heling | ..... | A63B 69/3608<br>473/213 |

FOREIGN PATENT DOCUMENTS

| | | | | | |
|---|---|---|---|---|---|
| JP | 2014-521139 | A | | 8/2014 | |
| JP | 2015-180276 | A | | 10/2015 | |
| JP | 2015-192713 | A | | 11/2015 | |
| KR | 101467218 | | * | 12/2014 | ..... G06F 3/00 |

* cited by examiner

SWING ANALYSIS DEVICE, SWING ANALYSIS METHOD, AND SWING ANALYSIS SYSTEM

The present application is based on, and claims priority from JP Application Serial Number 2018-118643, filed Jun. 22, 2018, the disclosure of which is hereby incorporated by reference herein in its entirety.

BACKGROUND

1. Technical Field

The present disclosure relates to a swing analysis device, a swing analysis method, and a swing analysis system.

2. Related Art

According to the related art, as a motion analysis device, for example, a golf support device which analyzes the state of a swing in practicing golf and displays the result of the swing analysis using numerical data or the like on a display unit is disclosed. JP-A-2015-180276 is an example of the related art.

However, the golf support device disclosed in JP-A-2015-180276 displays only the result of the analysis using numerical data or the like and therefore has a problem in that it is difficult for a user to grasp the result of the swing analysis including the state of the actual swing.

SUMMARY

A swing analysis device according to an aspect of the disclosure includes: an acquisition unit acquiring a swing video of a user; a processing unit deciding an impact timing and a tempo, based on the swing video; and a display unit displaying the swing video and the tempo. The display unit, while displaying the swing video, displays the tempo when the impact timing is reached in the swing video.

In the swing analysis device, the display unit may stop playing back the swing video when the impact timing is reached.

In the swing analysis device, the display unit may display the tempo until playback of the swing video ends, when and after the impact timing is reached.

In the swing analysis device, the swing video may be a video captured from a side opposite to a traveling direction of a ball hit by a swing.

In the swing analysis device, swing analysis may include processing to binarize a plurality of frames included in the swing video.

In the swing analysis device, the processing unit may compare a first frame of the plurality of frames with a second frame that is a frame immediately before the first frame, calculate a cumulative value of a number of pixels having different values, and decide the impact timing, based on a change in the cumulative value over the plurality of frames.

In the swing analysis device, the processing unit may decide a top timing and a swing start timing, based on the impact timing and the change in the cumulative value.

In the swing analysis device, the processing unit may decide the tempo, based on the impact timing, the top timing, and the swing start timing.

A swing analysis method according to another aspect of the disclosure includes: acquiring a swing video of a user; deciding an impact timing and a tempo, based on the swing video; and displaying the swing video and the tempo. The displaying includes, while displaying the swing video, displaying the tempo when the impact timing is reached in the swing video.

A swing analysis system according to still another aspect of the disclosure includes: a swing video providing device providing a swing video of a user; and a swing analysis device which includes an acquisition unit acquiring the swing video from the swing video providing device, a processing unit deciding an impact timing and a tempo, based on the swing video, and a display unit displaying the swing video and the tempo, wherein the display unit, while displaying the swing video, displays the tempo when the impact timing is reached in the swing video.

DESCRIPTION OF EXEMPLARY EMBODIMENTS

Hereinafter, preferred embodiments will be described in detail with reference to the drawings. However, the embodiments described below should not unduly limit the content of the disclosure described in the claims. Not all the components described below are necessarily essential components of the disclosure.

First Embodiment

1-1. Configuration of Swing Analysis Device

Figure 1A:
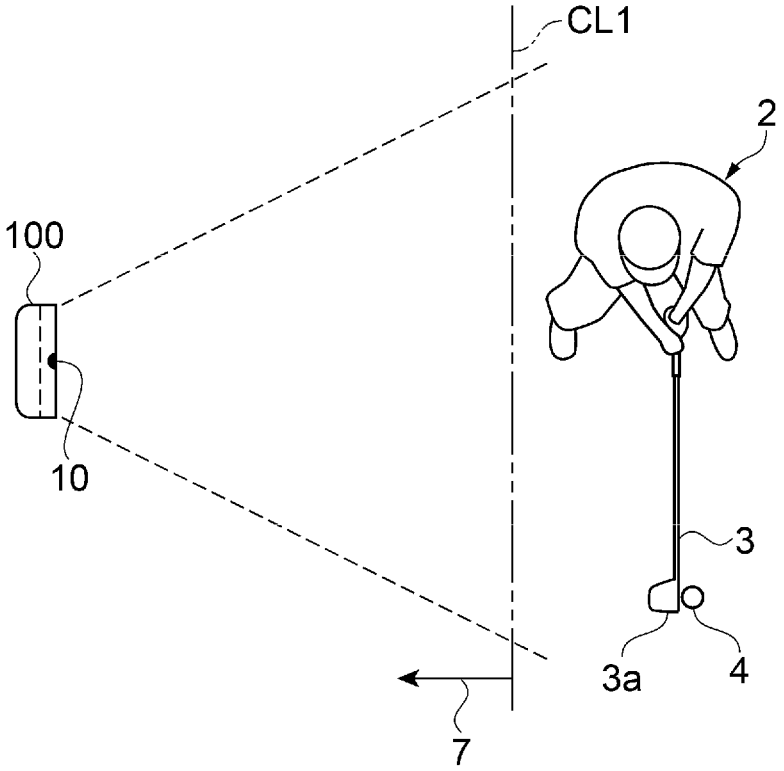
FIG. 1A is a plan view schematically showing an example of a direction of capturing a swing video.
Figure 1B:
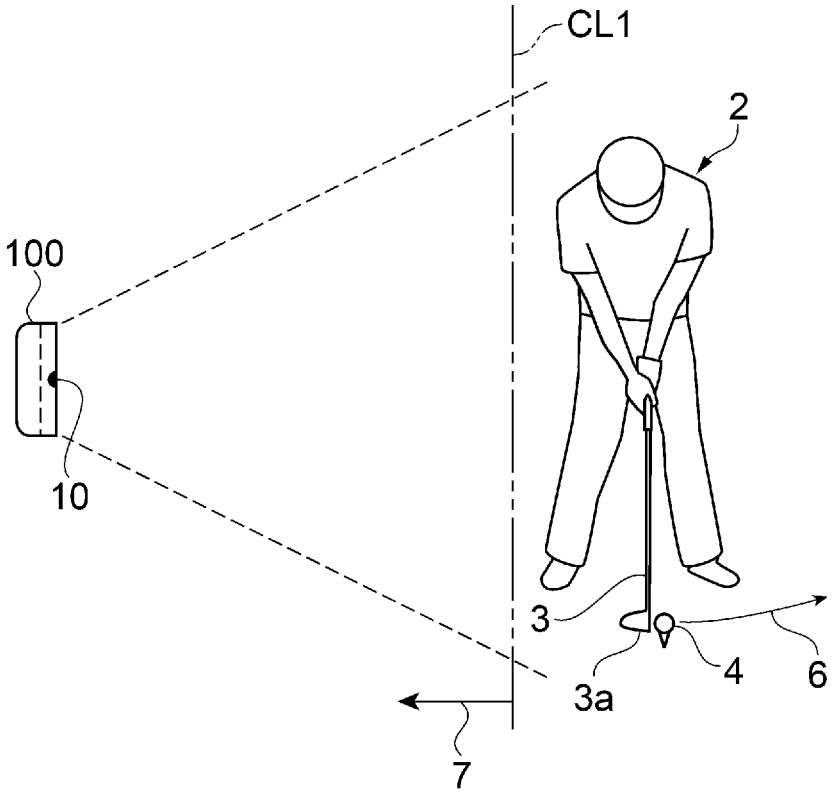
FIG. 1B is a front view schematically showing an example of the direction of capturing the swing video.
Figure 2:
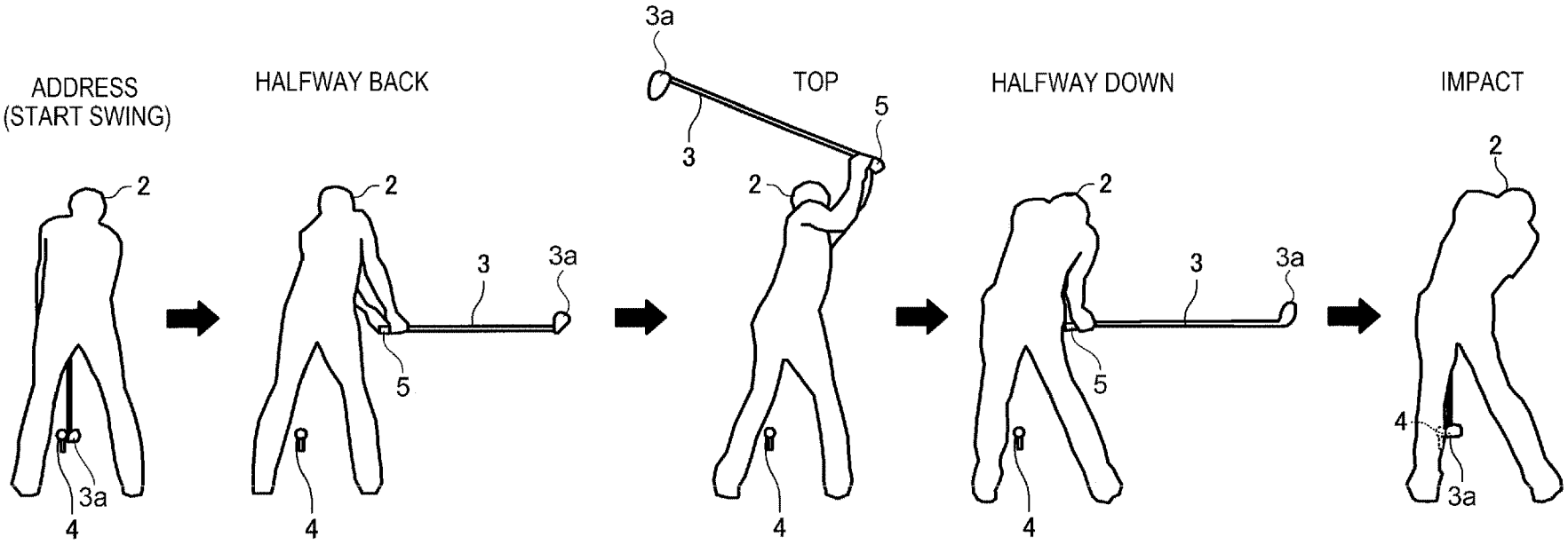
FIG. 2 is an explanatory view about a swing movement.
Figure 3:
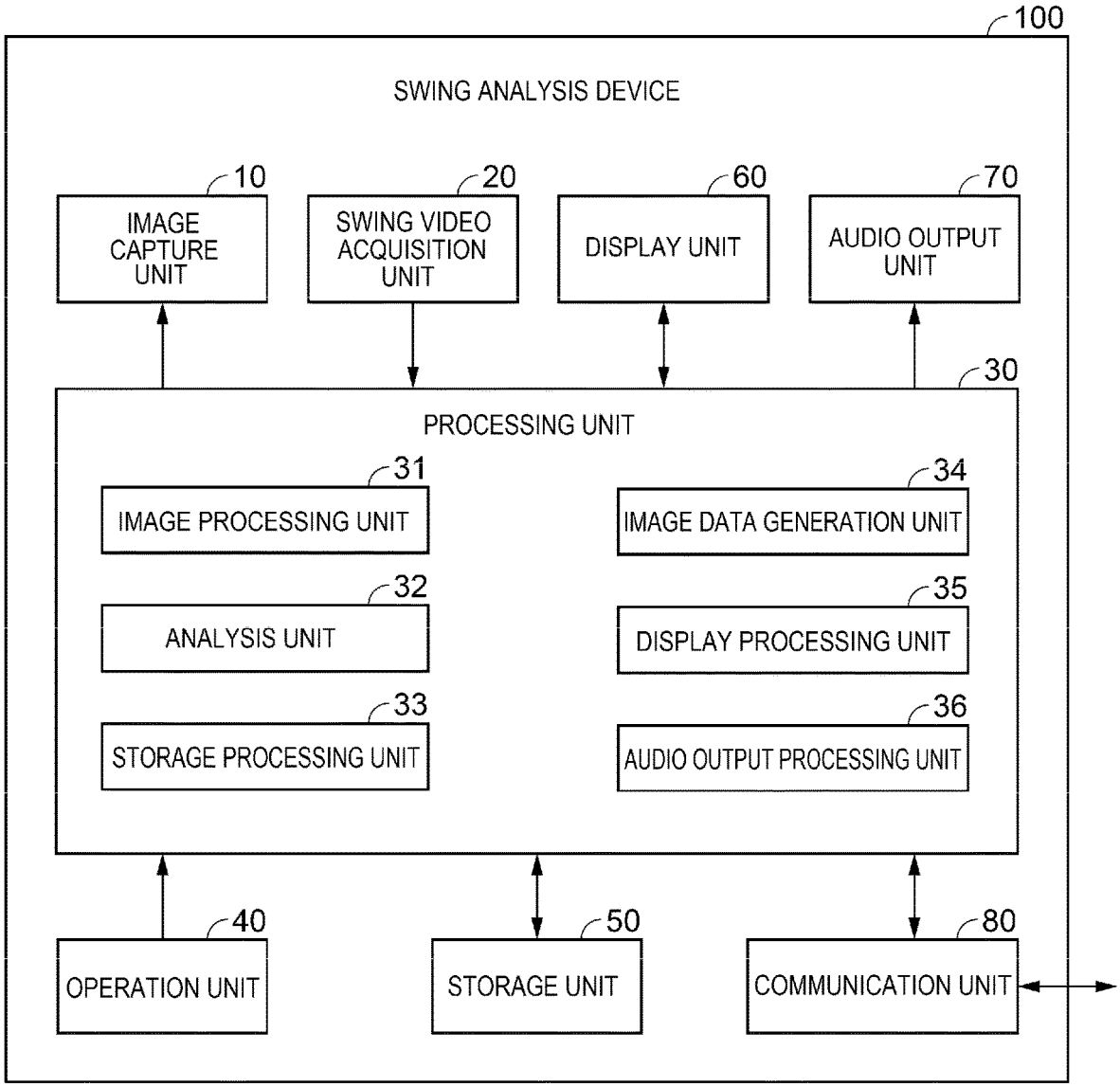
FIG. 3 is a block diagram showing an example of the configuration of a swing analysis device according to a first embodiment.

A swing analysis device according to a first embodiment will now be described, referring to FIGS. 1A, 1B, 2, and 3 and using an analysis of a swing in golf (hereinafter referred to as a golf swing) as an example of motion analysis. FIGS. 1A and 1B schematically show an example of a direction of capturing a swing video. FIG. 1A is a plan view. FIG. 1B is a front view. FIG. 2 is an explanatory view about a swing movement and shows movement procedures taken by a user to hit a ball in this embodiment. FIG. 3 is a block diagram showing an example of the configuration of the swing analysis device according to the first embodiment.

As shown in FIGS. 1A and 1B, an image capture unit 10 provided in a swing analysis device 100 of the first embodiment captures an image of a swing movement of swinging a golf club 3 to hit a golf ball 4 with a head 3*a* or swinging without hitting the ball, as a swing video from behind the user 2. The swing analysis device 100 carries out a swing analysis of the user 2, based on a change in pixel data of every frame forming the captured swing video, and displays the result of the analysis of the swing along with the swing video.

In this embodiment, the phrase "behind the user 2" refers to an area on the side away from the user 2 on the side opposite to the traveling direction of the ball hit by the swing (the direction in which the golf ball 4 flies out, indicated by an arrow 6 in the illustration) and not overlapping the swing movement area of the golf club 3, as indicated by an imaginary line CL1 and an arrow 7 in the illustration. Capturing the swing video from the side opposite to the traveling direction of the ball hit by the swing enables more secure capturing of the trajectory of the movement of the golf club 3 by the swing without obstructing the swing and thus can improve the accuracy of swing analysis.

The swing analysis device 100 is implemented by various information terminals (client terminals) such as a portable device like a smartphone, personal computer or tablet having the image capture unit 10 and a display function (not illustrated), or a wearable terminal like a head-mounted display (HMD) or wrist device.

The user 2 carries out a swing movement of swinging the golf club 3 to hit the golf ball 4 (shot) or a swing movement of swinging without hitting the ball, according to a predetermined procedure. The swing movement is, for example, a swing movement carried out in a practice range or a swing movement during a round on a golf course. Playing a round on a golf course or the like is often unsuitable for capturing a video, due to location and time constraints or the like. Therefore, in this embodiment, it is assumed that a swing video is captured in a practice range and that swing analysis of the swing video is carried out. In the practice range, the user 2 first sets the swing analysis device 100 having the image capture unit 10 at a position behind a hitting position (shot position) from where a swing video can be captured. The user 2 then swings the golf club 3, carries out at least one swing movement, and captures the swing video by the swing analysis device 100. The swing video can also be captured by another cameraman than the user 2, for example, an accompanying person.

A swing movement sequence of the user 2 hitting the golf ball 4 will now be described with reference to FIG. 2. As shown in FIG. 2, the swing movement carried out by the user 2 includes movements of starting a swing (backswing) from an address posture (still state) in the state where the user is holding a grip 5 of the golf club 3 (swing start timing), then going through a halfway-back state where the shaft of the golf club 3 becomes horizontal during the backswing, a top state where the backswing changes to downswing (top timing), and a halfway-down state where the shaft of the golf club 3 becomes horizontal during the downswing, and subsequently reaching an impact where the golf ball 4 is hit (impact timing). Although not illustrated, the movement sequence also includes follow-through, which is a movement after the impact. In this way, one swing movement is carried out by a movement sequence including starting a swing from an address posture, having follow-through after an impact, and then stopping the movement of the golf club 3.

The swing analysis device 100 captures a swing video sequence and carries out swing analysis based on pixel data of every frame forming the captured swing video. When capturing a swing video, the swing analysis device 100 may acquire the time (date and time) when the swing is carried out and weather information or the like. Also, at this time, the swing analysis device 100 can save (store) the result of swing analysis based on a swing video sequence every time the swing video is captured and analyzed, and thus can construct a swing analysis data list.

The user 2 can learn the result of the analysis of the captured swing movement sequence by operating an operation unit 40 (see FIG. 3) of the swing analysis device 100. Specifically, as the user 2 operates the operation unit 40 of the swing analysis device 100 and starts a swing analysis application, a swing video is played back on a display unit 60 (see FIG. 3) of the swing analysis device 100. Thus, the user 2 can view the result of the swing analysis including information such as the tempo of the swing displayed along with the swing video.

A specific example of the configuration of the swing analysis device 100 will now be described with reference to FIG. 3. As shown in FIG. 3, the swing analysis device 100 includes an image capture unit 10, a swing video acquisition unit 20 as an acquisition unit, a processing unit 30, an operation unit 40, a storage unit 50, a display unit 60, an audio output unit 70, and a communication unit 80. However, in the swing analysis device 100, a part of these components may be deleted or changed, or another component may be added according to need.

The image capture unit 10 includes a light receiving unit (not illustrated) including an optical lens (image pickup optical system) or CCD (charge-coupled device), not illustrated. The image capture unit 10 captures a swing by a subject (user 2) as a swing video formed by a plurality of frames and sends the swing video to the swing video acquisition unit 20, in response to an instruction from the processing unit 30 or from the operation unit 40 via the processing unit 30.

The swing video acquisition unit 20 as an acquisition unit acquires the captured swing video of the swing movement sequence of the user 2 from the image capture unit 10 and sends the swing video to an image processing unit 31 included in the processing unit 30, in response to an instruction from the processing unit 30 or from the operation unit 40 via the processing unit 30.

The processing unit 30 carries out swing analysis based on pixel data of every frame forming the swing video sent thereto, according to the swing analysis application or the like, and causes the display unit 60 to display the result of the analysis or causes the storage unit 50 to store the result of the analysis. The processing unit 30 functions as an image processing unit 31, an analysis unit 32, a storage processing unit 33, an image data generation unit 34, a display processing unit 35, and an audio output processing unit 36 that operate according to the swing analysis application or the like. The processing unit 30 thus can carry out processing to analyze the swing movement of the user 2 (swing analysis processing) and processing to display the result of the analysis along with the swing video of the golf swing by the user 2. The processing unit 30 has functions of a computer performing various kinds of control processing.

The image processing unit 31 binarizes every frame of the plurality of frames included in the acquired swing video, that is, the entirety of every frame. Every one of the binarized frames is used for analysis, as video data in time series. Since swing analysis is carried out based on the plurality of frames, every one of which is binarized in its entirety, the swing analysis can be carried out securely and easily, based on a black/white determination about the image of the entire swing video.

The analysis unit 32 carries out swing analysis based on the video data in which the entirety of every frame is binarized and which is processed in time series. The analysis unit 32 compares a first frame of the plurality of frames with a second frame that is a frame immediately before the first frame. The analysis unit 32 then counts the number of pixels having different binarized pixel values between these frames, for example, the number of pixels changed from white to black or pixels changed from black to white, and calculates a cumulative value of the number of pixels having different pixel values (also referred to as the number of different pixels). The analysis unit 32 repeats a similar calculation in time series, calculates a change in the cumulative value of the number of pixels having different pixel values between the frames, from the beginning to the end of the video data, and decides an impact timing based on the change. As the impact timing, a time point when a more prominent change in the cumulative value of the number of pixels having different values appears and when the largest cumulative value of the number of pixels having different pixel values (number of different pixels) is acquired, is decided.

The analysis unit 32 decides a top timing and a swing start timing, based on the decided impact timing as a reference point and based on the state of the change in the cumulative value of the number of pixels having different pixel values between the frames. The analysis unit 32 also decides a tempo of swing, based on the impact timing, the top timing, and the swing start timing thus decided.

At the impact timing, a more prominent change in the cumulative value of the number of pixels having different values appears. Therefore, based on the impact timing as a reference point, the top timing and the swing start timing can be decided. The tempo of swing can be easily decided, based on the impact timing, the top timing, and the swing start timing.

The storage processing unit 33 carries out processing to read/write various programs and various data from/into the storage unit 50. For example, the storage processing unit 33 carries out processing to store the swing video based on the swing movement sequence by the user 2 and the result of its analysis in association with each other in the storage unit 50, or processing to store other information such as a round score on a golf course or the like in the storage unit 50.

The image data generation unit 34 carries out processing to generate image data corresponding to an image displayed on the display unit 60. The image data generation unit 34 generates, for example, video data that can play back the swing video processed by the image processing unit 31, or image data that can display analysis information such as various timings and swing tempo decided by the analysis unit 32. The image data generation unit 34 also generates, for example, image data of a line graph showing the cumulative value of the number of pixels having different pixel values (number of different pixels) in time series.

The display processing unit 35 carries out processing to cause the display unit 60 to display various images (including the video data and the image data generated by the image data generation unit 34, and a character, symbol, or the like). For example, the display processing unit 35 causes the display unit 60 to display a swing video based on the video data generated by the image data generation unit 34. The display processing unit 35 also causes the display unit 60 to display the image data of a line graph displaying the cumulative value of the number of different pixels (number of different pixels) in time series, as superimposed on the swing video. The display processing unit 35 also decides the timing of displaying the result of analysis such as the swing tempo information displayed along with the swing video and causes the display unit 60 to display the result of analysis.

The audio output processing unit 36 carries out processing to cause the audio output unit 70 to output various sounds (including a speech, buzz, or the like). For example, the audio output processing unit 36 may cause the audio output unit 70 to output numerical information of the result of analysis as audio information along with the image display. Also, the audio output processing unit 36 may, for example, cause the audio output unit 70 to output a chime reporting the start of the video display, or may cause the audio output unit 70 to output a timing sound indicating various timings of the swing as audio information corresponding to the swing video.

The operation unit 40 can carry out processing to acquire data corresponding to an operation by the user 2 and send the data to the processing unit 30, or send an instruction to start playback processing of the swing video, to the processing unit 30. The operation unit 40 may be a touch panel-type display, button, key, microphone or the like. The user 2 can operate the operation unit 40 to input information from a display screen and cause the display unit 60 to show a display based on the input information.

The storage unit 50 is made up of a recording medium such as various IC memories including ROM (read-only memory), flash ROM or RAM (random access memory), hard disk, or memory card. The storage unit 50 stores a program for the processing unit 30 to carry out various kinds of calculation processing and control processing, and various programs and data or the like for implementing an application function.

In this embodiment, a swing analysis application and a swing analysis program for executing swing analysis processing, read out by the processing unit 30, are stored in the storage unit 50. The swing analysis application and the swing analysis program may be stored in a non-volatile recording medium (computer-readable recording medium) in advance. Alternatively, the processing unit 30 may receive the swing analysis application and the swing analysis program from a server (not illustrated) via a network (not illustrated) and stores these in the storage unit 50. In the storage unit 50, information about the round score of the user 2 on a golf course or the like, golf club information and the like may also be stored, as reference information.

The display unit 60 can display the swing video processed by the processing unit 30 and a character, graph, table, animation or another image showing the result of analysis. The display unit 60 may be, for example, a CRT, LCD, touch panel-type display, head-mounted display (HMD) or the like. Also, the functions of the operation unit 40 and the display unit 60 may be implemented on a single touch panel-type display.

As will be described in detail later, the display unit 60 in this embodiment can display information including the video and the result of analysis as follows.

(1) a swing video about a golf swing carried out by the user 2

(2) a line graph showing a change in the cumulative value of the number of different pixels between frames (number of different pixels) in time series (in which the swing start timing, the top timing, the impact timing and the like can be viewed)

(3) information of swing tempo (4) inclination angle information of the golf club 3 and the body of the user 2

(5) past information about a golf round and practice carried out by the user 2

The display of the information of swing tempo by the display unit 60 may be performed when and after the impact timing is reached in the playback of the swing video and by the time the playback of the swing video ends. Displaying the information of swing tempo in this way enables the user 2 to check the user's own swing and analysis data such as tempo, for every swing.

The audio output unit 70 is configured to output audio information such as a speech or chime, in order to present the result of processing (analysis information) by the processing unit 30 in the form of audio information. The audio output unit 70 can report the result of analysis, timing or the like as audio information corresponding to the swing video. The audio output unit 70 may be, for example, a speaker, buzzer or the like.

The communication unit 80 can carry out processing to transmit the swing video and the analysis information (swing analysis data) about the golf swing by the user 2 to an information processing device such as a server or computer via a network (not illustrated). The communication unit 80 can also carry out processing to receive the swing video and the analysis information (swing analysis data) of the user 2 from an information processing device such as a server or computer.

1-2. Swing Analysis Method

Figure 4:
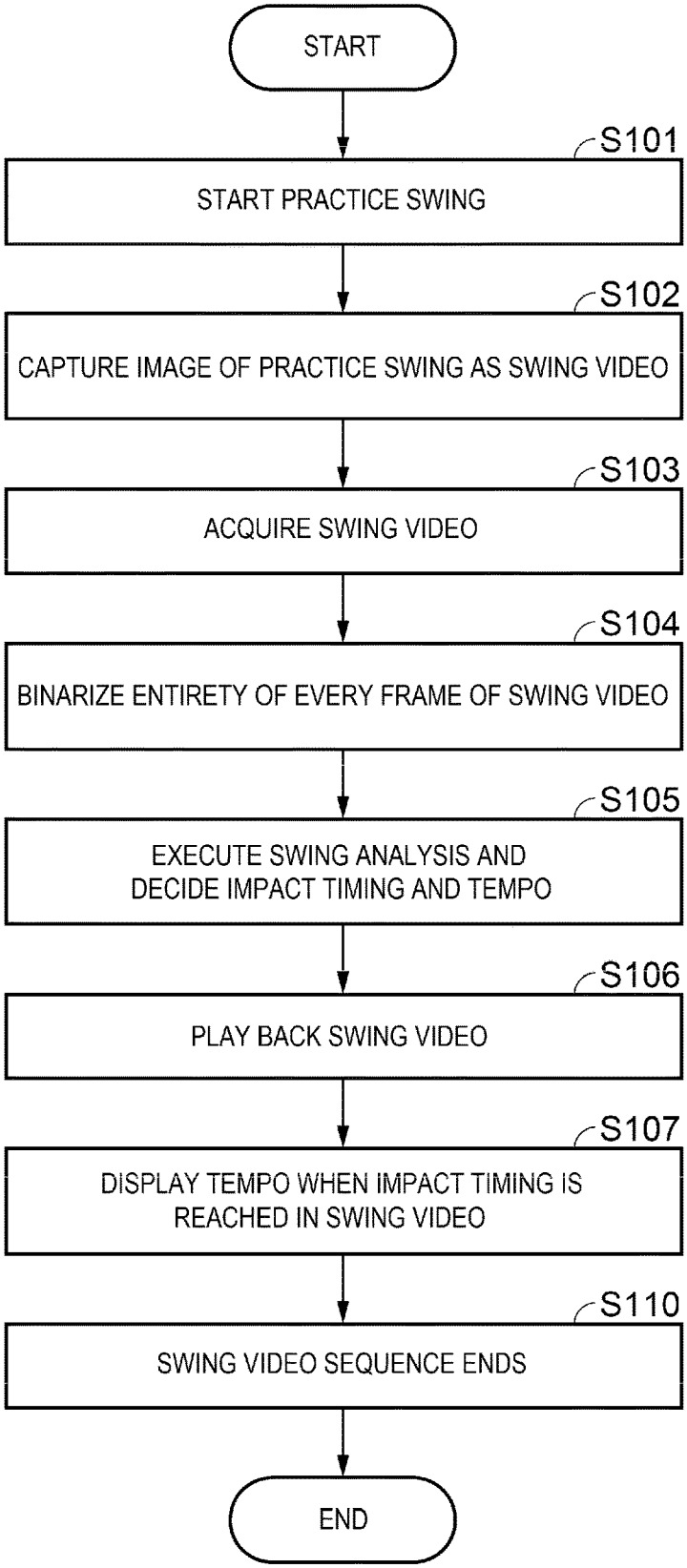
FIG. 4 is a flowchart showing procedures of a swing analysis method using the swing analysis device according to the first embodiment.

Procedures of a swing analysis method using the swing analysis device 100 will now be described with reference to FIG. 4. FIG. 4 is a flowchart showing procedures of the swing analysis method using the swing analysis device according to the first embodiment.

The processing unit 30 executes processing for swing analysis according to an instruction from the user 2 and the swing analysis application. The procedures of the swing analysis method will now be described with reference to the flowchart of FIG. 4. The procedures shown in FIG. 4 illustrate a case example where the user 2 carries out a swing to hit the golf ball 4, for example, in a practice range, and where the swing is analyzed. The components forming the swing analysis device 100 are denoted by the same reference signs.

As shown in FIG. 4, this swing analysis method includes step S101 where the user 2 starts a practice swing, step S102 where a swing video is captured, step S103 where the swing video is acquired, step S104 where every frame of the swing video is binarized, step S105 where swing analysis is executed, thus deciding an impact timing and a tempo, and step S106 where the swing video is played back. The swing analysis method also includes step S107 where the swing tempo is displayed when the swing reaches the impact timing in the played-back swing video, and step S110 where the playback of the swing video ends.

First, in the practice range, the user 2 places the swing analysis device 100 having the image capture unit 10 at a position behind a hitting position (shot position) from where a swing video can be captured, as described with reference to FIGS. 1A and 1B, and sets the swing analysis device 100 in the state of being able to capture a swing video. The image capture unit 10 may be provided in another image capture device that is different from the swing analysis device 100.

The user 2 then starts swinging the golf club 3 (step S101). The user 2 carries out at least one swing movement and captures a swing video by the image capture unit 10 (step S102). The swing video acquisition unit 20 acquires the captured swing video (step S103) and sends the acquired swing video to the processing unit 30. The swing video can also be captured by another cameraman than the user 2, for example, an accompanying person.

Next, the processing unit 30 (image processing unit 31) of the swing analysis device 100 binarizes the entirety of every frame of a plurality of frames forming the swing video sent from the swing video acquisition unit 20 (step S104). The image processing unit 31 sends every binarized frame to the analysis unit 32 as video data in time series.

The analysis unit 32 carries out swing analysis based on the video data in which the entirety of every frame sliced out in time series is binarized (step S105). The analysis unit 32 counts the number of pixels having different values between the binarized frames. Specifically, the analysis unit 32 compares, for example, a first frame which is an n-th frame of the plurality of frames with a second frame which is a frame immediately before the first frame, that is, an (n−1)th frame. The analysis unit 32 then counts the number of pixels changed from white to black or from black to white, of the binarized pixels in the compared frames, and calculates a cumulative value of the number of pixels having different pixel values (also referred to as the number of different pixels).

Subsequently, the analysis unit 32 carries out similar comparison between an (n+1)th frame, which is next to the n-th frame of the plurality of frames, as a first frame, and a frame immediately before the first frame, that is, the n-th frame, as a second frame, and calculates a cumulative value of the number of pixels having different pixel values (number of different pixels).

In this way, the analysis unit 32 repeats similar calculations in time series, calculates a change in the cumulative value of the number of pixels having different pixel values between the frames, from the beginning to the end of the video data, and decides an impact timing based on the change. In the description below, the cumulative value of the number of pixels having different pixel values may be referred to as the number of different pixels.

Figure 5:
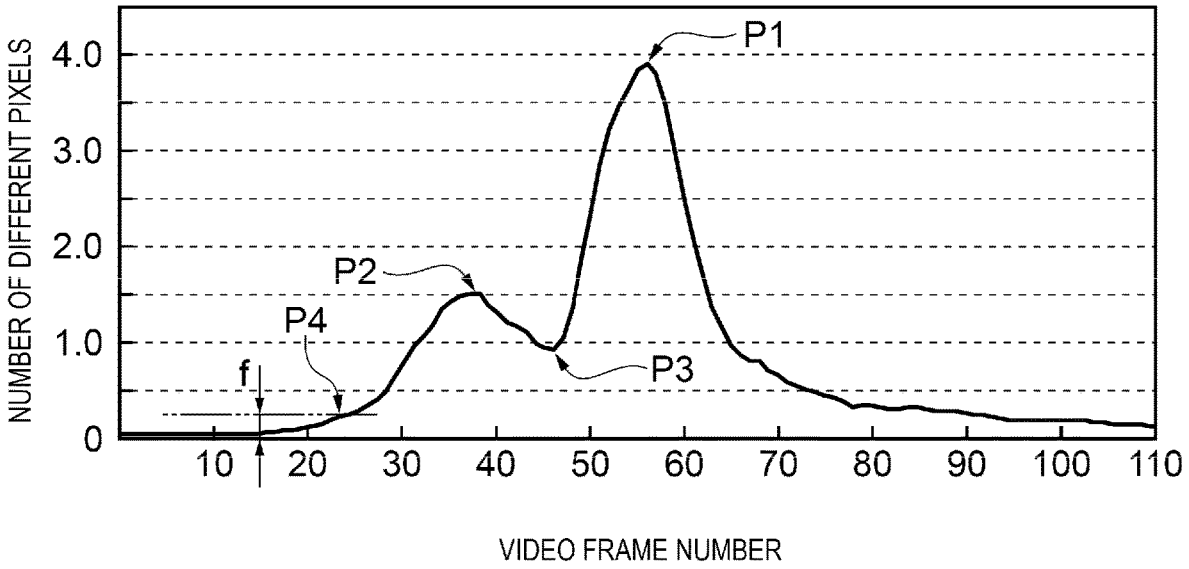
FIG. 5 is a graph showing an example of analysis based on the number of different pixels.

The change in the cumulative value of the number of pixels having different pixel values can expressed as a line graph showing the change between frames (number of different pixels), as shown in FIG. 5. FIG. 5 is a graph showing an example of analysis based on the number of different pixels. The cumulative value of the number of pixels having different pixel values (number of different pixels) increases as the movement of the subject becomes larger. Therefore, in a captured video of a typical golf swing, data including two peaks corresponding to the backswing and the downswing involving a large movement of the subject, and a valley corresponding to the top position involving a relatively small movement of the subject between these two peaks, is provided, as shown in FIG. 5.

In the line graph shown in FIG. 5, the number of different pixels gradually increases from the start side of the video frames, and a first peak (time point when a large number of different pixels are present) indicated by point P2 appears. Subsequently, the number of different pixels decreases, forming a valley indicated by point P3, and then the number of different pixels increases again and a second peak (time point when the largest number of different pixels are present) indicated by point P1 appears. Subsequently, the number of different pixels quickly decreases. Then, while the number of different pixels gradually decreases, the swing video ends (the end of the frames). That is, in a swing video showing a swing movement sequence, the number of different pixels changes with such behavior as in the line graph shown in FIG. 5.

The impact timing is decided, based on the change in the number of different pixels as described above. The inventor has found that the largest change in movement in the swing movement sequence appears at the impact timing. Therefore, the timing of point P1, where the largest number of different pixels are present, can be decided as the impact timing. The analysis unit 32 then decides the top timing and the swing start timing, based on the decided impact timing as a reference point and based on the state of the change in number of different pixels. In this way, the top timing and the swing start timing can be decided, based on the impact timing when a more prominent change in the cumulative value of the number of pixels having different values (number of different pixels) appears.

Next, the analysis unit 32 decides the time point of the valley indicated by point P3, which is a time point before the decided impact timing in time series and between the two peaks (time points when a large number of different pixels are present) indicated by points P1 and P2, as the top timing. In the top position, the movement pauses or becomes gentle. Therefore, such a valley shape showing a decrease in the number of different pixels is formed. Thus, the time point of the valley indicated by point P3 can be decided as the top timing.

Next, the analysis unit 32 decides a time point which is before point P2 and when a predetermined number of different pixels set as a threshold f is exceeded, as the swing start timing indicated by point P4. As the threshold f, for example, a 1/10 value of the number of different pixels at the impact timing (point P1) can be set. The analysis unit 32 then decides the swing tempo, based on the impact timing (point P1), the top timing (point P3), and the swing start timing (point P4) thus decided, and the time elapsed.

In this way, the top timing (point P3) and the swing start timing (point P4) can be decided, based on the impact timing (point P1) when the largest number of different pixels are present, that is, when a prominent change in the number of different pixels appears, as a reference point. Also, the swing tempo can be easily decided, based on the impact timing, the top timing, and the swing start timing.

Next, the image data generation unit 34 carries out processing to generate image data corresponding to an image displayed on the display unit 60, based on the swing analysis information. For example, the image data generation unit 34 generates video data that can play back the swing video processed by the image processing unit 31, or image data that can display analysis information such as the various timings in the swing and the swing tempo decided by the analysis unit 32. The image data generation unit 34 also generates image data of a line graph (see FIG. 5) showing the change in the number of different pixels in time series.

Figure 6A:
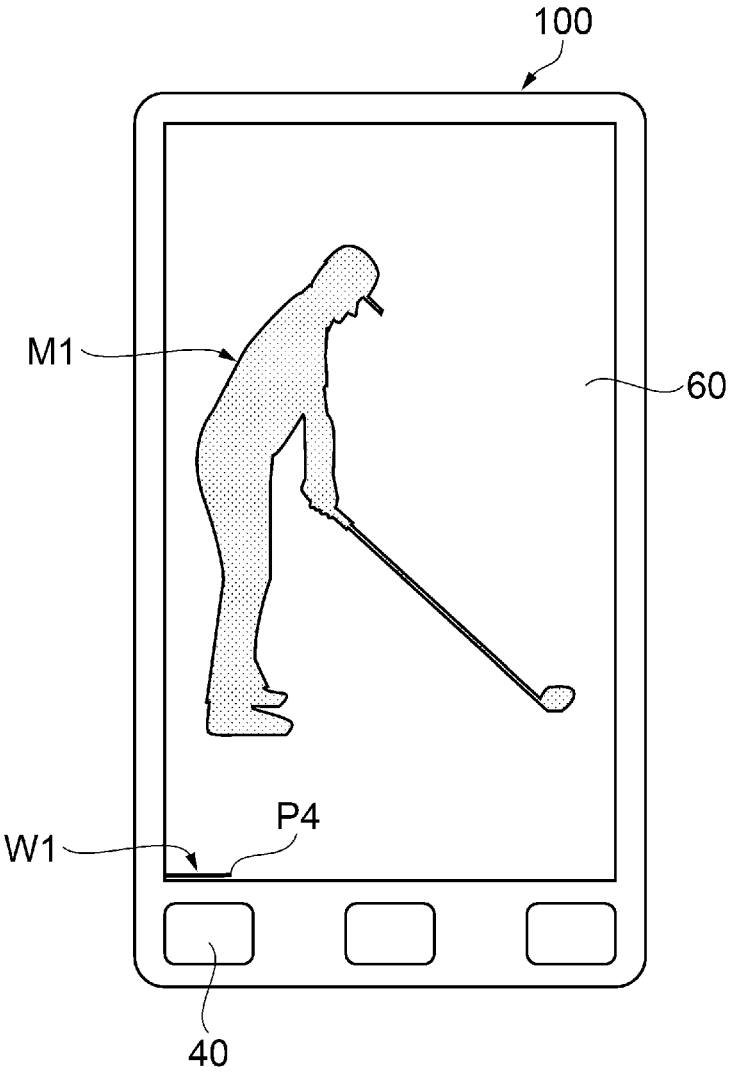
FIG. 6A shows an example of displaying a swing video at a swing start timing.
Figure 6B:
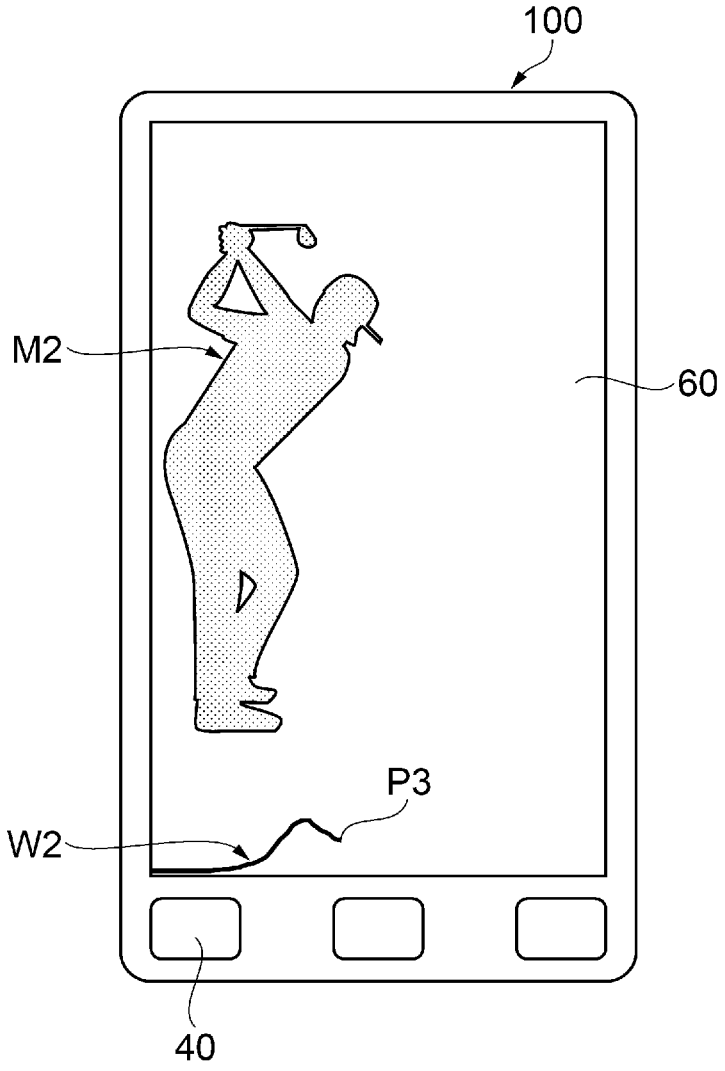
FIG. 6B shows an example of displaying the swing video at a top timing.
Figure 6C:
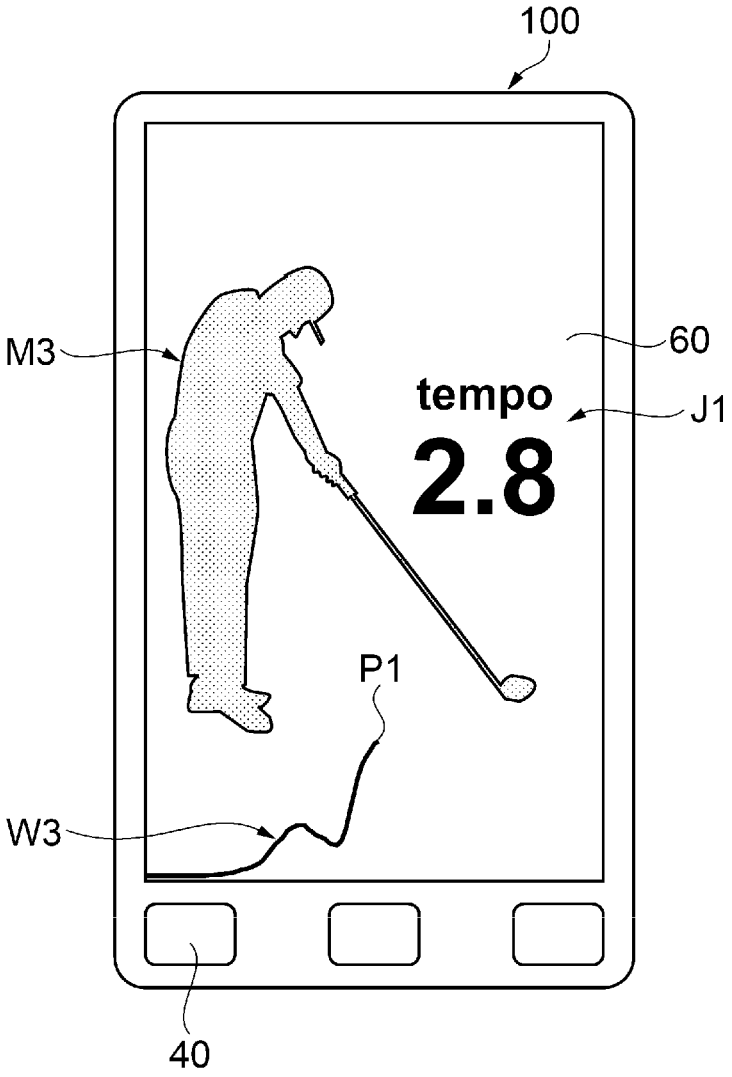
FIG. 6C shows an example of displaying the swing video at an impact timing.
Figure 6D:
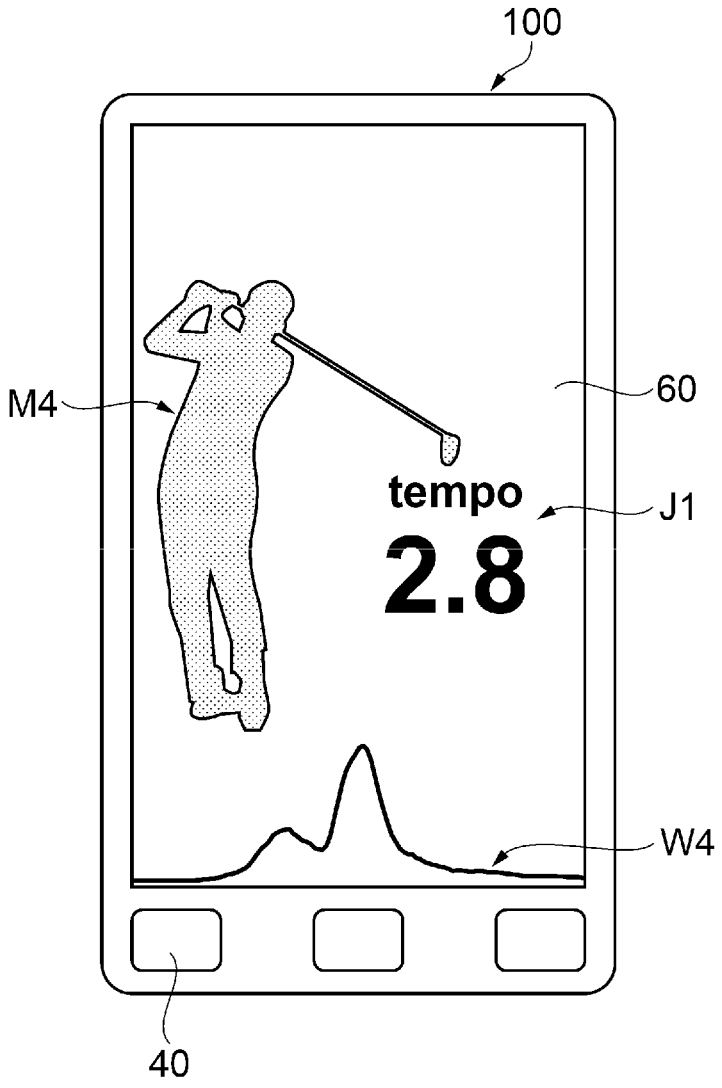
FIG. 6D shows an example of displaying the swing video at a swing end timing.

Next, the display processing unit 35 carries out processing to cause the display unit 60 to display various images (including the video data and image data generated by the image data generation unit 34, and a character, symbol or the like). A specific display method will now be described with reference to FIGS. 6A to 6D. FIG. 6A shows an example of displaying a swing video at a swing start timing. FIG. 6B shows an example of displaying the swing video at a top timing. FIG. 6C shows an example of displaying the swing video at an impact timing. FIG. 6D shows an example of displaying the swing video at a swing end timing. In FIGS. 6A to 6D showing a binarized screen displayed in black and white, the "black" part is hatched for the sake of convenience of the illustration.

For example, the display processing unit 35 plays back a swing video on the display unit 60, based on the video data generated by the image data generation unit 34 (step S106). The swing video is played back, for example, as a video including a screen M1 at the time point of the swing start shown in FIG. 6A, a screen M2 at the time point of the top shown in FIG. 6B, a screen M3 at the time point of the impact shown in FIG. 6C, and a screen M4 at the time point of the finish (swing end) shown in FIG. 6D. In this case, the display processing unit 35 can cause the display unit 60 to display a line graph showing the change in the number of different pixels linked in time series to the time points of the screens M1, M2, M3, and M4, such as a line W1 shown in FIG. 6A (up to point P4 of the swing start), a line W2 shown in FIG. 6B (up to point P3 of the top), a line W3 shown in FIG. 6C (up to point P1 of the impact), and a line W4 shown in FIG. 6D (up to the finish). Displaying the change in the number of different pixels linked to the playback of the swing video in this manner can facilitate better understanding of the state of the swing. The screens M1, M2, M3, and M4 are display examples showing the frames at the respective time points (timings) in the played-back swing video, as still images.

The display processing unit 35 can decide to display the result of analysis such as the swing tempo information displayed along with the swing video, for example, at the time point when the impact timing is reached. When the impact timing is reached in the swing video (screen M3), the display processing unit 35 causes the display unit 60 to display, for example, the swing tempo information as information J1 including a numerical value superimposed on the video screen (step S107), as shown in FIG. 6C. The display of the information J1, which is the tempo information, continues until the playback of the swing video ends.

At the time point when the playback of the video for the user 2 to view the result of the golf swing analysis ends (the finish (swing end) shown in FIG. 6D), the display processing unit 35 ends the display operation on the display unit 60 (step S110). The processing unit 30 then ends the series of procedures of the swing analysis method.

In the swing analysis device 100 and the swing analysis method using the swing analysis device 100 according to the first embodiment, a swing video of the user 2 is acquired and swing analysis is carried out based on the acquired swing video, thus deciding an impact timing and a tempo. The swing analysis device 100 displays information about the tempo when the impact timing is reached in the played-back swing video. The user 2 carefully observes the user's own swing video before the impact timing of the swing and checks the actual swing form in the swing video after the impact timing. Then, the user can check objective analysis data such as the tempo displayed as superimposed on the swing video and therefore can analyze the user's own swing more deeply.

In the swing analysis device 100 and the swing analysis method, only the swing video is displayed until the impact timing, and the analysis data such as the tempo is displayed when the impact timing is reached. Therefore, the risk of the user 2 being distracted due to a large amount of information provided at a time and unable to concentrate on necessary information can be reduced.

In the swing analysis device 100 and the swing analysis method, the capturing of the swing video to the swing analysis, the playback of the swing video, and the display of the result of the analysis can be carried out in a single device. Therefore, the user 2 can easily carry out swing analysis without using a plurality of devices.

1-3. Modification Example of Swing Analysis Method

Figure 7:
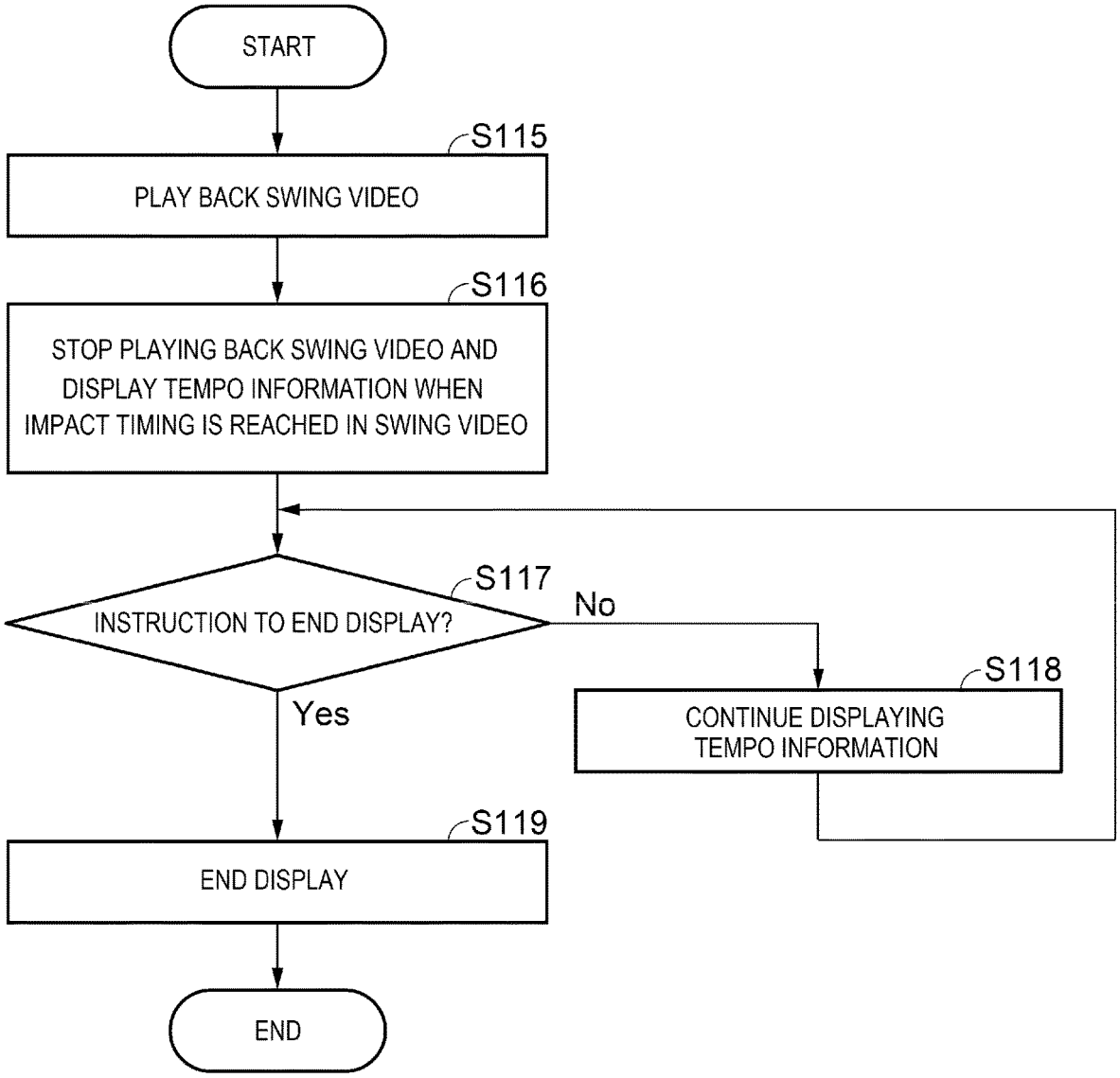
FIG. 7 is a flowchart showing a modification example of procedures of the swing analysis method.

As the swing video playback procedures (steps S106 to S107), the following procedures can be applied. The procedures will now be described with reference to FIG. 7. FIG. 7 is a flowchart showing a modification example of the procedures of the swing analysis method. In the description below, different steps from those in the first embodiment are described and the description of similar procedures is omitted.

The display processing unit 35 starts playing back the swing video on the display unit 60 (step S115). At this time, the display processing unit 35 may cause the display unit 60 to display a line graph plotting the change in the number of different pixels linked with the swing video in time series.

The display processing unit 35 can decide the timing of displaying the result of analysis such as the swing tempo information displayed along with the swing video, for example, by displaying the impact timing. When the impact timing is reached in the swing video on the display unit 60, the display processing unit 35 causes the display unit 60 to top playing back the swing video and display the swing tempo information as numerical information (step S116).

Next, the processing unit 30 determines whether an instruction to end the display is given or not (step S117). When an instruction to end the display is given (Yes in step S117), the processing unit 30 instructs the display processing unit 35 to end the display operation on the display unit 60 (step S119). When an instruction to end the display is not given (No in step S117), the tempo information continues being displayed until an instruction to end the display is given (step S118). As the instruction to end the display, for example, an instruction by the user 2 or an instruction based on a time setting with a timer or the like can be used.

Since the playback of the swing video is stopped when the impact timing is reached, and the analysis data such as tempo is displayed in the state where the playback of the swing video is stopped, the swing video and the analysis data can be provided separately, based on the impact timing as a reference point. Thus, the risk of the user 2 being distracted due to a large amount of information provided at a time and unable to concentrate on necessary information can be reduced.

Second Embodiment 2-1. Configuration of Swing Analysis System

Figure 8:
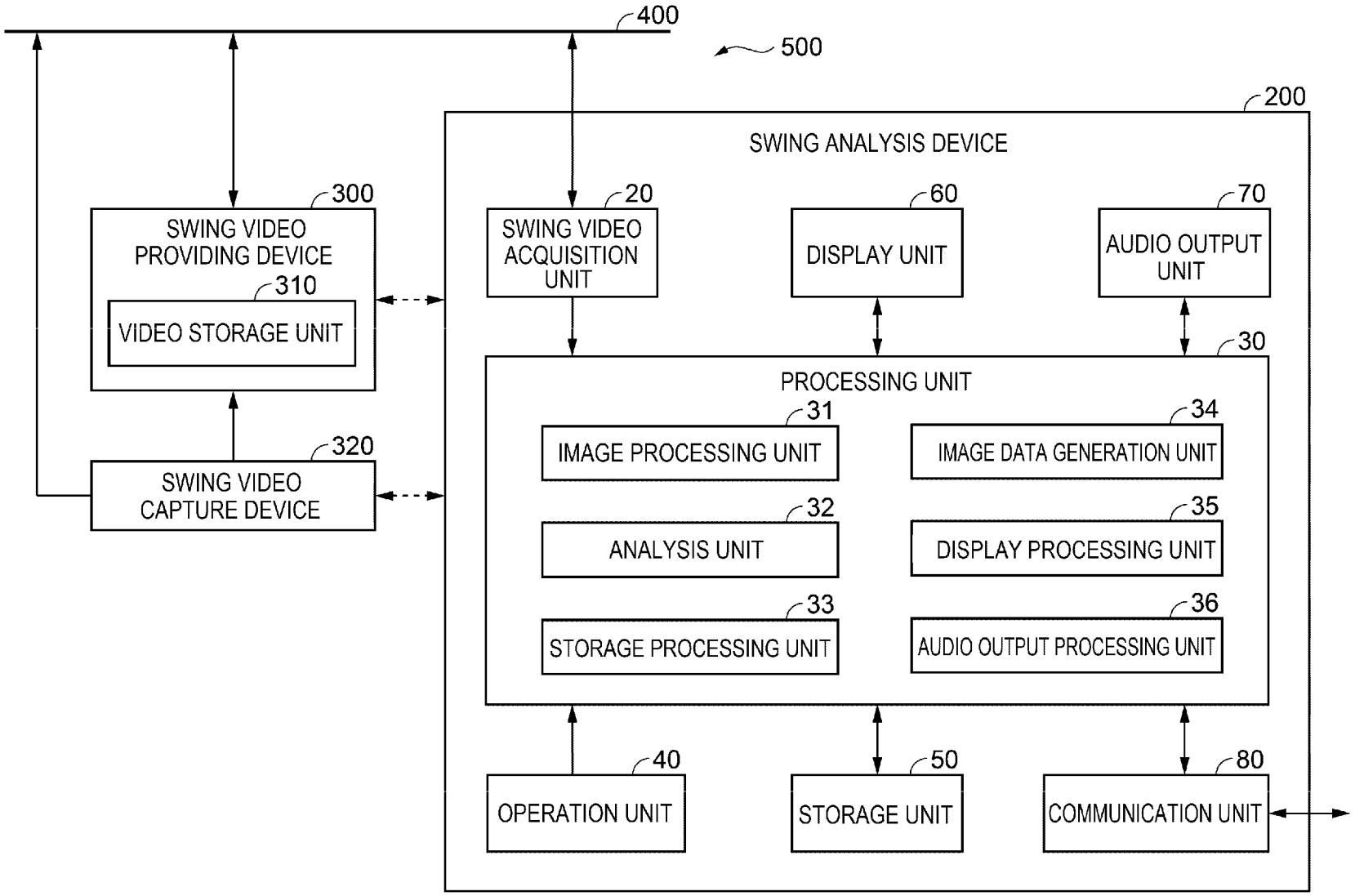
FIG. 8 is a block diagram showing an example of the configuration of a swing analysis system to which a swing analysis device according to a second embodiment is applied.

A swing analysis system to which a swing analysis device according to a second embodiment is applied will now be described with reference to FIG. 8. FIG. 8 is a block diagram showing an example of the configuration of the swing analysis system to which the swing analysis device according to the second embodiment is applied.

As shown in FIG. 8, a swing analysis system 500 to which a swing analysis device 200 according to the second embodiment is applied includes the swing analysis device 200, a swing video providing device 300 configured to provide the swing analysis device 200 with a swing video stored in a video storage unit 310, and a swing video capture device 320 capturing a swing video.

The swing analysis device 200 is implemented by various information terminals (client terminals) such as a portable device like a smartphone, personal computer or tablet having a display function (not illustrated), or a wearable terminal like a head-mounted display (HMD) or wrist device.

The swing analysis device 200 is connected to the swing video providing device 300 and the swing video capture device 320. The swing analysis device 200, and the swing video providing device 300 and the swing video capture device 320 may be connected together via a network 400. The network 400 may be a wide area network (WAN) such as the internet, or may be a local area network (LAN). Alternatively, the swing analysis device 200, and the swing video providing device 300 and the swing video capture device 320 may communicate with each other via short-range wireless communication or wired communication without using the network 400. The processing carried out by the swing analysis device 200 may be implemented by an information processing device such as a server (not illustrated). The swing video providing device 300 and the swing video capture device 320 may be implemented as a single information device having the functions of both.

The swing video providing device 300 can store (record) a swing movement carried out by the user 2 (see FIG. 1A) or another user (player) as video data in the video storage unit 310 and transmit the swing video (video data) of the user to the swing video providing device 300 in response to a request from the swing analysis device 200.

The swing video capture device 320 captures a swing video for swing analysis from behind the user 2, as in the first embodiment. The swing video capture device 320 includes a light receiving unit (not illustrated) including an optical lens (image pickup optical system) or CCD (charge-coupled device), not illustrated. As the swing video capture device 320, for example, a video camera, smartphone or the like can be applied. The swing video capture device 320 captures a swing by a subject (user 2) as a swing video formed by a plurality of frames and sends the swing video to the swing video providing device 300 or the swing analysis device 200, in response to an instruction from the user 2.

The swing analysis device 200 (swing video acquisition unit 20) acquires a swing video which needs analyzing from the swing video providing device 300 or the swing video capture device 320, and carries out swing analysis based on pixel data of every frame forming the acquired swing video. The swing analysis device 200 may acquire the time (date and time) when the swing is carried out and weather information or the like, along with the swing video. Also, at this time, the swing analysis device 200 can save (store) the result of swing analysis based on a swing video sequence every time the swing video is captured and analyzed, and thus can construct a swing analysis data list.

The user 2 can learn the result of the analysis of a desired swing movement by operating an operation unit 40 of the swing analysis device 200. Specifically, as the user 2 operates the operation unit 40 of the swing analysis device 200 and starts a swing analysis application, a swing video is played back on a display unit 60 of the swing analysis device 200. Thus, the user 2 can view the result of the swing analysis including information such as the tempo of the swing displayed along with the swing video.

As a specific configuration example, the swing analysis device 200 includes a swing video acquisition unit 20, a processing unit 30, an operation unit 40, a storage unit 50, a display unit 60, an audio output unit 70, and a communication unit 80, as shown in FIG. 8. However, in the swing analysis device 200, a part of these components may be deleted or changed, or another component may be added according to need. The swing video acquisition unit 20, the processing unit 30, the operation unit 40, the storage unit 50, the display unit 60, the audio output unit 70, and the communication unit 80 forming the swing analysis device 200 are similar to those in the configuration example of the swing analysis device 100 of the first embodiment and therefore will not be described further in detail.

2-2. Swing Analysis Method of Swing Analysis System

Figure 9:
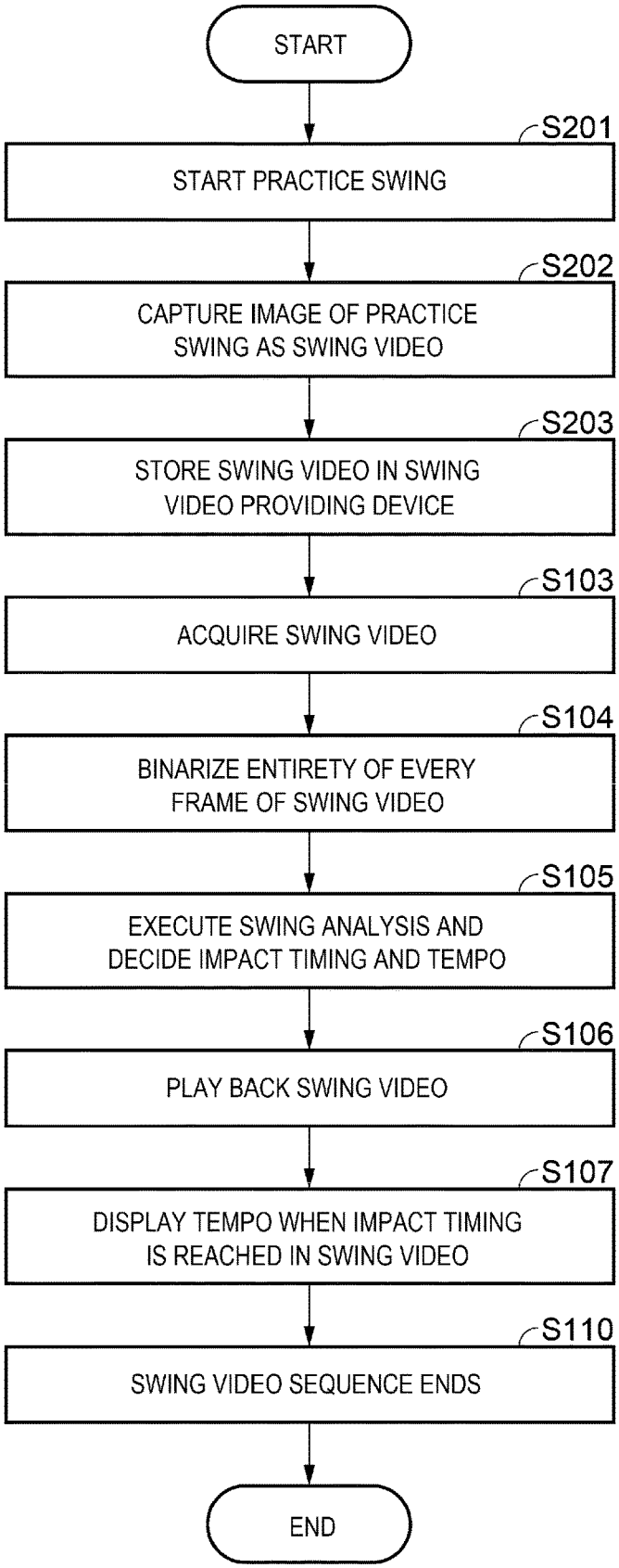
FIG. 9 is a flowchart showing analysis procedures of the swing analysis system using the swing analysis device according to the second embodiment.

Procedures of a swing analysis method using the swing analysis system 500 using the swing analysis device 200 will now be described with reference to FIG. 9. FIG. 9 is a flowchart showing analysis procedures of the swing analysis system using the swing analysis device according to the second embodiment.

As in the first embodiment, the processing unit 30 executes processing for swing analysis according to an instruction from the user 2 and the swing analysis application. The procedures of the swing analysis method will now be described with reference to the flowchart of FIG. 9. The same components as those forming the swing analysis device 100 are described with the same reference signs. The same steps as the procedures in the swing analysis method of the first embodiment are denoted by the same reference signs and are not described further in detail. The procedures shown in FIG. 9 illustrate a case example where the user 2 swings the golf club 3 to hit the golf ball 4, for example, in a practice range, and where the swing is analyzed, as described with reference to FIG. 1A.

As shown in FIG. 9, this swing analysis method includes step S201 where the user 2 starts a practice swing, step S202 where a swing video is captured by the swing video capture device 320, and step S203 where the captured swing video is stored in the swing video providing device 300. These three steps are different from the first embodiment. After step S203, the swing analysis method includes the steps from step S103 where the swing video is acquired to step S110 where the playback of the swing video ends.

First, in the practice range, the user 2 places the swing video capture device 320 at a position behind a hitting position (shot position) from where a swing video can be captured, as described with reference to FIGS. 1A and 1B, and sets the swing video capture device 320 in the state of being able to capture a swing video. The swing video capture device 320 may be provided in another image capture device.

The user 2 then starts swinging the golf club 3 (step S201). The user 2 carries out at least one swing movement and captures a swing video by the swing video capture device 320 (step S202). The swing video capture device 320 sends the captured swing video to the swing video providing device 300. The swing video providing device 300 stores the swing video sent thereto, in the video storage unit 310 (step S203). The swing video capture device 320 can also send the captured swing video to the swing analysis device 200 via the network 400 or using short-range wireless communication or wired communication.

Next, the swing video acquisition unit 20 of the swing analysis device 200 acquires the swing video from the swing video providing device 300 (step S103). Subsequently, step S104 where the swing video is binarized frame by frame, step S105 where swing analysis is executed, thus deciding an impact timing and a tempo, step S106 where the swing video is played back, step S107 where the tempo of the swing is displayed when the swing reaches the impact timing in the played-back swing video, and step S110 where the playback of the swing video ends, are executed. These steps are similar to those described in the first embodiment and therefore will not be described further.

The swing analysis device 200, too, carries out swing analysis similar to that in the first embodiment and displays, for example, swing tempo information or the like along with the swing video on the display unit 60 in steps S106 and S107.

In the swing analysis system 500 using the swing analysis device 200 as described above, the swing analysis device 200 acquires a swing video of the user 2 from the swing video providing device 300, carries out swing analysis based on the acquired swing video, and decides an impact timing and a tempo. The swing analysis device 200 displays the tempo when the impact timing is reached in the played-back swing video. The user 2 carefully observes the user's own swing video before the impact timing of the swing and checks the actual swing form in the swing video after the impact timing. Then, the user can check objective analysis data such as the tempo displayed as superimposed on the swing video and therefore can analyze the user's own swing more deeply.

In the above-described example, the swing analysis device 200 displays the tempo when the impact timing is reached in the played-back swing video. However, this is not limiting. The swing analysis device 200 may display information such as the time elapsed from the swing start to the top position, the halfway-back position, or the angle of rotation at the top position or the like, when the impact timing is reached in the played-back swing video.

3. Modification Examples of Display

Figure 10A:
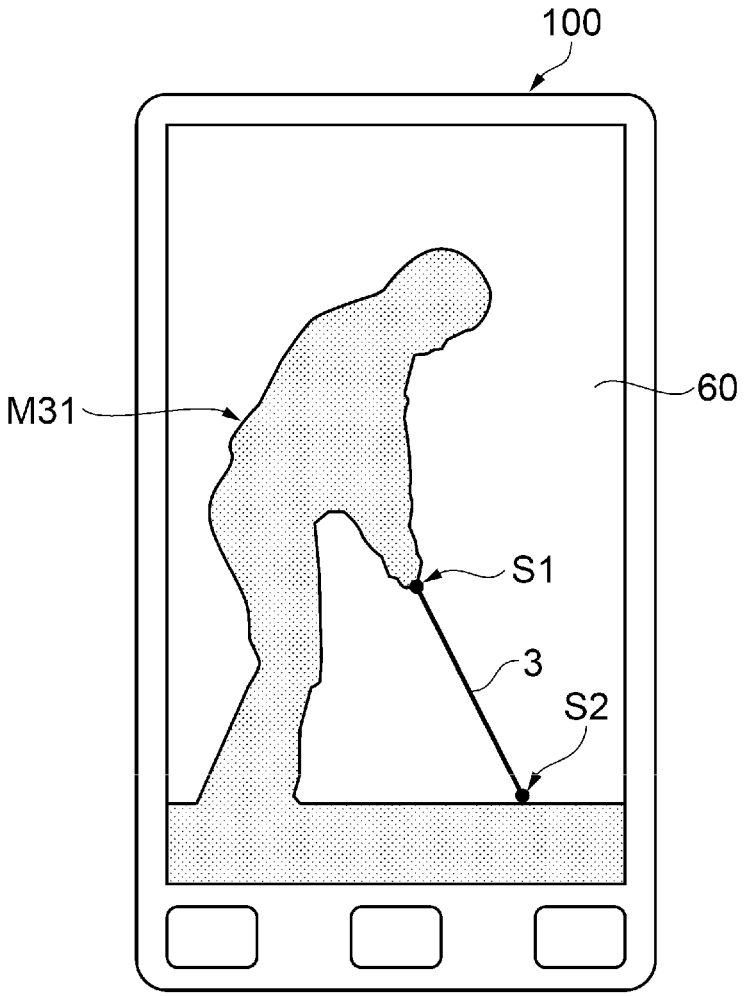
FIG. 10A explains modification example 1 of the display.
Figure 10B:
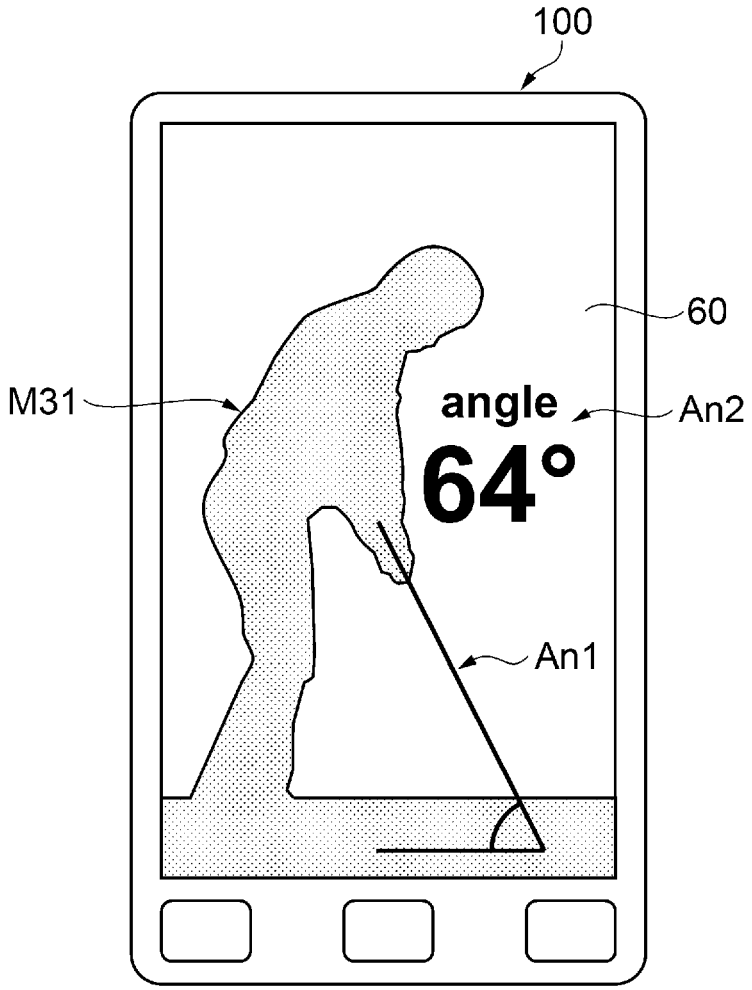
FIG. 10B shows the state where a club angle is displayed in modification example 1 of the display.
Figure 11:
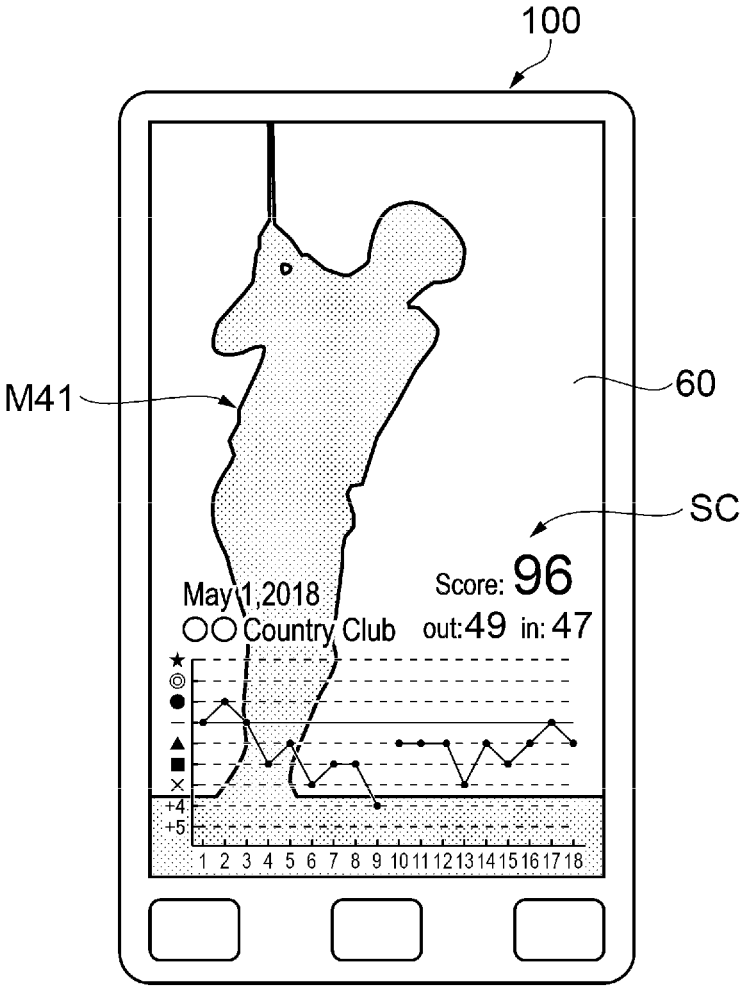
FIG. 11 explains modification example 2 of the display.

The display on the display unit 60 can be carried out as in modification example 1 described with reference to FIGS. 10A and 10B and modification example 2 described with reference to FIG. 11, instead of the foregoing embodiment. FIG. 10A explains modification 1 of the display. FIG. 10B shows the state where a club angle is displayed in modification example 1 of the display. FIG. 11 explains modification example 2 of the display.

Modification 1

Modification example 1 of the display will now be described with reference to FIGS. 10A and 10B. Modification example 1 of the display can be applied to a configuration where the display unit 60 of the swing analysis device 100 has the function of a touch panel-type display. In modification example 1 of the display, the angle of the golf club 3 (shaft) is calculated based on the video displayed on the display unit 60, and an angle display mark An1 and angle data An2 shown in FIG. 10B are displayed as superimposed on the display in the state where a binarized screen M3 is paused.

As shown in FIG. 10A, the video displayed on the display unit 60 is paused, for example, at a scene equivalent to the impact timing, resulting in a still image M31. The user 2 slides a finger or the like in contact with the touch panel-type display, along a part equivalent to the golf club 3 in the still image M31 displayed on the display unit 60. At this time, the display unit 60, with the function of touch panel-type display, detects a start point S1 of the contact (position where the finger touches the display first) and an end point S2 (position where the finger is released), and sends the detected points to the processing unit 30 (see FIG. 3). The processing unit 30 calculates an angle with respect to the horizontal direction on the display unit 60, based on the start point S1 and the end point S2 thus detected.

The processing unit 30 then causes the angle display mark An1 and the angle data An2 to be displayed as superimposed on the still image M31 displayed on the display unit 60 of the swing analysis device 100, as shown in FIG. 10B. Such a display according to modification example 1 enables the user 2 to easily learn the angle of the golf club 3 in the user's own golf swing.

The swing analysis device 100 can also display the angle of inclination of the body of the user 2 or information about the angle of inclination on the display unit 60, for example, when the user 2 slides a finger or the like in contact with the touch panel-type display, along a part equivalent to the body of the user 2 instead of the part equivalent to the golf club 3.

Modification Example 2

Modification example 2 of the display will now be described with reference to FIG. 11. In modification example 2 of the display, for example, score information SC of a past round is displayed on the display unit 60 of the swing analysis device 100. As the score information SC, the score of the past round can be shown in a graph for every hole, or the total score can be shown as numerical information.

In FIG. 11, the score information SC is displayed as superimposed on a still image M41 in the finish state (swing end) as a background displayed on the display unit 60. However, the background image may be any image. The background image is not limited to a still image. For example, the score information SC may be displayed as superimposed on the swing video, when the impact timing is reached in the swing video. Alternatively, the score information SC may be displayed when the impact timing is reached in the swing video. Such a display according to modification example 2 enables the user 2 to easily learn the user's own golf score along with the state of the swing.

The disclosure includes a configuration that is substantially the same as the configuration described in the embodiment (for example, a configuration having the same function, method, and result, or a configuration having the same objective and effect). The disclosure also includes a configuration formed by replacing an inessential part of the configuration described in the embodiment. The disclosure also includes a configuration having the same advantageous effect as the configuration described in the embodiment or a configuration achieving the same objective. The disclosure also includes a configuration formed by adding the related-art technique to the configuration described in the embodiment.

The contents derived from the foregoing embodiment are described below as individual aspects.

Aspect 1

A swing analysis device according to this aspect includes: an acquisition unit acquiring a swing video of a user; a processing unit deciding an impact timing and a tempo, based on the swing video; and a display unit displaying the swing video and the tempo. The display unit, while displaying the swing video, displays the tempo when the impact timing is reached in the swing video.

According to this aspect, the tempo is displayed when the impact timing is reached in the displayed swing video. Therefore, the user carefully observes the user's own swing video before the impact timing of the swing and checks the actual swing form in the swing video after the impact timing. Then, the user can check objective analysis data such as the tempo displayed as superimposed on the swing video and therefore can analyze the user's own swing more deeply.

Also, only the swing video is displayed until the impact timing, and the analysis data such as the tempo is displayed when the impact timing is reached. Therefore, the risk of the user being distracted due to a large amount of information provided at a time and unable to concentrate on necessary information can be reduced.

Aspect 2

In the swing analysis device described in the foregoing aspect, the display unit may stop playing back the swing video when the impact timing is reached.

According to this aspect, the playback of the swing video is stopped when the impact timing is reached, and the analysis data such as the tempo is displayed in the state where the playback of the swing video is stopped. Since the swing video and the analysis data are provided separately based on the impact timing as a reference point, the risk of the user being distracted due to a large amount of information provided at a time and unable to concentrate on necessary information can be reduced.

Aspect 3

In the swing analysis device described in the foregoing aspect, the display unit may display the tempo until playback of the swing video ends, when and after the impact timing is reached.

According to this aspect, the user can check the analysis data such as the user's own swing and tempo for every swing.

Aspect 4

In the swing analysis device described in the foregoing aspect, the swing video may be a video captured from a side opposite to a traveling direction of a ball hit by a swing.

According to this aspect, the swing video is captured from the side opposite to the traveling direction of the ball hit by the swing. Thus, the trajectory of the movement of the club by the swing can be more securely captured without obstructing the swing and therefore the accuracy of swing analysis can be improved.

Aspect 5

In the swing analysis device described in the foregoing aspect, swing analysis may include processing to binarize a plurality of frames included in the swing video.

According to this aspect, the swing analysis is carried out based on the plurality of binarized frames. Therefore, the swing analysis can be easily carried out, based on a black/white determination.

Aspect 6

In the swing analysis device described in the foregoing aspect, the processing unit may compare a first frame of the plurality of frames with a second frame that is a frame immediately before the first frame, calculate a cumulative value of a number of pixels having different values, and decide the impact timing, based on a change in the cumulative value over the plurality of frames.

According to this aspect, the impact timing can be decided, simply based on the information about the change in the pixel information of every one of the plurality of frames sliced out of the swing video, without using a detector such as a sensor.

Aspect 7

In the swing analysis device described in the foregoing aspect, the processing unit may decide a top timing and a swing start timing, based on the impact timing and the change in the cumulative value.

According to this aspect, the top timing and the swing start timing can be decided, based on the impact timing when a more prominent change in the cumulative value of the number of pixels having different values appears, and the change in the cumulative value.

Aspect 8

In the swing analysis device described in the foregoing aspect, the processing unit may decide the tempo, based on the impact timing, the top timing, and the swing start timing.

According to this aspect, the tempo of the swing can be easily decided, based on the impact timing, the top timing, and the swing start timing.

Aspect 9

A swing analysis method according to this aspect includes: acquiring a swing video of a user; deciding an impact timing and a tempo, based on the swing video; and displaying the swing video and the tempo. The displaying includes, while displaying the swing video, displaying the tempo when the impact timing is reached in the swing video.

According to this aspect, the swing video of the user is acquired, and the impact timing and the tempo are decided, based on the acquired swing video. The tempo is displayed when the impact timing is reached in the displayed swing video. Therefore, the user carefully observes the user's own swing video before the impact timing of the swing and checks the actual swing form in the swing video after the impact timing. Then, the user can check objective analysis data such as the tempo displayed as superimposed on the swing video and therefore can analyze the user's own swing more deeply.

Aspect 10

A swing analysis system according to this aspect includes: a swing video providing device providing a swing video of a user; and a swing analysis device which includes an acquisition unit acquiring the swing video from the swing video providing device, a processing unit deciding an impact timing and a tempo, based on the swing video, and a display unit displaying the swing video and the tempo, wherein the display unit, while displaying the swing video, displays the tempo when the impact timing is reached in the swing video.

According to this aspect, the swing analysis device acquires the swing video of the user from the swing video providing device and decides the impact timing and the tempo, based on the acquired swing video. The swing analysis device displays the tempo when the impact timing is reached in the displayed swing video. Therefore, the user carefully observes the user's own swing video before the impact timing of the swing and checks the actual swing form in the swing video after the impact timing. Then, the user can check objective analysis data such as the tempo displayed as superimposed on the swing video and therefore can analyze the user's own swing more deeply.

What is claimed is:

1. A swing analysis device comprising:

a processor configured to acquire a swing video that is a captured image of a swing by a user, determine an impact timing and a tempo, based on the swing video, binarize a plurality of frames included in the swing video, compare a first frame of the plurality of frames with a second frame that is a frame immediately before the first frame, calculate a cumulative value of a number of pixels having different values, and decide the impact timing based on a change in the cumulative value over the plurality of frames; and a display configured to display the tempo when the swing by the user reaches the impact timing in the swing video.

2. The swing analysis device according to claim 1, wherein the display pauses playback of the swing video when the impact timing is reached.

3. The swing analysis device according to claim 1, wherein the display displays the tempo until playback of the swing video ends, when and after the impact timing is reached.

4. The swing analysis device according to claim 2, wherein the swing video is a video captured from a side opposite to a traveling direction of a ball hit by a swing by the user.

5. The swing analysis device according to claim 1, wherein the processor is configured to decide a top timing and a swing start timing, based on the impact timing and the change in the cumulative value.

6. The swing analysis device according to claim 5, wherein the processor is configured to decide the tempo, based on the impact timing, the top timing, and the swing start timing.

7. A swing analysis method comprising:

capturing an image of a swing by a user and acquiring a swing video;

causing a processor to decide an impact timing and a tempo, based on the swing video;

causing the processor to compare a first frame of the plurality of frames with a second frame that is a frame immediately before the first frame;

causing the processor to calculate a cumulative value of a number of pixels having different values; causing the processor to decide the impact timing based on a change in the cumulative value over the plurality of frames; and causing a display to display the tempo when the swing by the user reaches the impact timing in the swing video.

8. The swing analysis method according to claim 7, wherein the display pauses playback of the swing video when the impact timing is reached.

9. The swing analysis method according to claim 8, wherein the display displays the tempo until playback of the swing video ends, when and after the impact timing is reached.

10. The swing analysis method according to claim 7, further comprising causing the processor to binarize a plurality of frames included in the swing video.

11. A swing analysis system comprising:

a video recorder configured to capture an image of a swing by a user and providing provide a video; and a swing analysis device which comprises a processor configured to acquire a swing video from the video recorder, determine an impact timing and a tempo, based on the swing video, binarize a plurality of frames included in the swing video, compare a first frame of the plurality of frames with a second frame that is a frame immediately before the first frame, calculate a cumulative value of a number of pixels having different values, and decide the impact timing based on a change in the cumulative value over the plurality of frames, and a display configured to display the tempo when the swing by the user reaches the impact timing in the swing video.

* * * * *